US008733805B2

(12) United States Patent
Nazzari

(10) Patent No.: US 8,733,805 B2
(45) Date of Patent: May 27, 2014

(54) SECURITY SEAL ASSEMBLY

(75) Inventor: Ian A. Nazzari, Moraga, CA (US)

(73) Assignee: NIC Products Inc., Walnut Creek, CA (US)

( * ) Notice: Subject to any disclaimer, the term of this patent is extended or adjusted under 35 U.S.C. 154(b) by 256 days.

(21) Appl. No.: 13/191,513

(22) Filed: Jul. 27, 2011

(65) Prior Publication Data

US 2013/0026771 A1 Jan. 31, 2013

(51) Int. Cl.
*B65D 27/30* (2006.01)
*G09F 3/03* (2006.01)

(52) U.S. Cl.
USPC ..... 292/317; 292/307 R; 292/307 B

(58) Field of Classification Search
USPC ..... 292/307 R, 307 B, 320, 322, 327, 317
See application file for complete search history.

(56) References Cited

U.S. PATENT DOCUMENTS

| | | | | | |
|---|---|---|---|---|---|
| 210,641 | A | | 12/1878 | Smith et al. | |
| 409,034 | A | | 8/1889 | Gillespie | |
| 511,642 | A | * | 12/1893 | Nadon | 292/320 |
| 998,878 | A | | 7/1911 | Dinsmoor | |
| 1,054,440 | A | * | 2/1913 | Murray | 292/320 |
| 1,059,689 | A | | 4/1913 | Webb | |
| 1,079,839 | A | | 11/1913 | Ciernia | |
| 1,131,085 | A | | 3/1915 | Reilly | |
| 1,132,970 | A | | 3/1915 | Peyton | |
| 1,381,975 | A | | 6/1921 | McKenzie | |
| 1,512,632 | A | | 10/1924 | O'Connor | |
| 1,626,273 | A | * | 4/1927 | Dietze | 292/321 |
| 1,647,398 | A | | 11/1927 | Draheim et al. | |
| 1,727,754 | A | | 9/1929 | Dessauer | |
| 1,863,041 | A | | 6/1932 | Dessauer | |
| 1,878,991 | A | | 9/1932 | Murray | |
| 1,945,965 | A | | 2/1934 | Behrman | |
| 1,964,014 | A | * | 6/1934 | Wenk | 292/320 |
| 1,964,897 | A | * | 7/1934 | Wenk | 292/320 |
| 1,982,438 | A | | 11/1934 | Keidel | |
| 1,987,351 | A | * | 1/1935 | Rose | 292/328 |
| 1,987,737 | A | | 1/1935 | Goddard | |

(Continued)

FOREIGN PATENT DOCUMENTS

| | | |
|---|---|---|
| DE | 2262421 | 7/1973 |
| EP | 0537400 B1 | 7/1996 |

(Continued)

OTHER PUBLICATIONS

International Search Report and Written Opinion in PCT/US2012/048225, Oct. 16, 2012.

(Continued)

*Primary Examiner* — Carlos Lugo
(74) *Attorney, Agent, or Firm* — Workman Nydegger

(57) ABSTRACT

A security seal using a captured lock wire for sealing a device in a manner revealing tampering with the seal includes a locking insert that fits closely within a central cavity of an outer body and is locked within the outer body against removal without visible damage to the insert or the outer body using locking fingers on the insert that cooperate with locking abutments in the cavity that permit insertion of the locking insert into the central cavity but not removal there from. A free end of the lock wire is captured by being threaded through apertures and grooves in the insert and outer body after being secured to a device to be sealed.

12 Claims, 8 Drawing Sheets

(56) References Cited

U.S. PATENT DOCUMENTS

| | | | | | |
|---|---|---|---|---|---|
| 2,020,198 | A | | 11/1935 | Miller | |
| 2,497,434 | A | | 2/1950 | Borland | |
| 2,587,876 | A | | 12/1950 | Moore | |
| 2,599,700 | A | | 6/1952 | Di Palma | |
| 2,809,065 | A | * | 10/1957 | Erke | 292/307 R |
| 3,367,701 | A | | 2/1968 | Wenk, Jr. | |
| 3,375,033 | A | | 3/1968 | Moberg | |
| 3,591,223 | A | | 7/1971 | Castro Neto | |
| 3,712,655 | A | | 1/1973 | Fuehrer | |
| 3,736,017 | A | | 5/1973 | Kaiho | |
| 3,841,118 | A | | 10/1974 | Stone | |
| 3,954,294 | A | | 5/1976 | Iwamoto et al. | |
| 3,980,332 | A | * | 9/1976 | King, Sr. | 292/320 |
| 3,987,653 | A | | 10/1976 | Lyon et al. | |
| 4,106,801 | A | | 8/1978 | Neto | |
| 4,175,782 | A | | 11/1979 | Neto | |
| 4,502,305 | A | | 3/1985 | Bakker | |
| 4,512,599 | A | * | 4/1985 | De Lima | 292/307 R |
| 4,687,240 | A | | 8/1987 | Swift | |
| 4,722,562 | A | | 2/1988 | Burt | |
| 4,733,893 | A | * | 3/1988 | Davis et al. | 292/320 |
| 4,736,604 | A | | 4/1988 | Zeller et al. | |
| 4,775,175 | A | | 10/1988 | Swift | |
| 4,782,613 | A | | 11/1988 | Guiler et al. | |
| 4,793,641 | A | | 12/1988 | Sokol | |
| 4,793,644 | A | | 12/1988 | Swift | |
| 4,802,700 | A | | 2/1989 | Stevenson et al. | |
| 4,818,002 | A | | 4/1989 | Netto | |
| 4,832,387 | A | | 5/1989 | Guiler | |
| 4,836,590 | A | * | 6/1989 | Swift | 292/320 |
| 4,887,855 | A | | 12/1989 | Tritton et al. | |
| 4,893,853 | A | | 1/1990 | Guiler | |
| 4,909,552 | A | * | 3/1990 | Weber et al. | 292/320 |
| 4,940,268 | A | | 7/1990 | Lesquir et al. | |
| 4,968,075 | A | | 11/1990 | Lesquir et al. | |
| 5,118,148 | A | | 6/1992 | Netto | |
| 5,120,097 | A | | 6/1992 | Fattori et al. | |
| 5,180,200 | A | | 1/1993 | Georgopoulos et al. | |
| 5,314,219 | A | | 5/1994 | Georgopoulos et al. | |
| 5,345,657 | A | | 9/1994 | Shimizu | |
| 5,348,180 | A | | 9/1994 | Shepard | |
| 5,402,958 | A | | 4/1995 | Mahaney | |
| 5,419,599 | A | | 5/1995 | Georgopoulos | |
| 5,427,423 | A | | 6/1995 | Georgopoulos | |
| 5,452,930 | A | | 9/1995 | Morgan | |
| 5,489,034 | A | | 2/1996 | Netto | |
| 5,577,395 | A | | 11/1996 | Kuykendall | |
| 5,762,386 | A | | 6/1998 | Fuehrer | |
| 5,782,513 | A | | 7/1998 | Nazzari | |
| 5,788,294 | A | | 8/1998 | Leon et al. | |
| 5,871,243 | A | | 2/1999 | Wenk | |
| 6,000,736 | A | | 12/1999 | Leon et al. | |
| 6,007,121 | A | | 12/1999 | Dreisbach et al. | |
| 6,128,932 | A | | 10/2000 | Mainetti et al. | |
| D436,015 | S | | 1/2001 | Yu | |
| 6,227,016 | B1 | | 5/2001 | Yu | |
| 6,283,517 | B1 | | 9/2001 | Nazzari | |
| D450,560 | S | | 11/2001 | Yu | |
| 6,389,854 | B1 | | 5/2002 | Huang | |
| 6,390,519 | B1 | | 5/2002 | Dreisbach et al. | |
| 6,416,091 | B1 | | 7/2002 | Wenk et al. | |
| 6,481,765 | B1 | * | 11/2002 | Jelavic | 292/307 R |
| 6,550,829 | B1 | | 4/2003 | Dobson | |
| 6,578,886 | B1 | | 6/2003 | Bystry et al. | |
| 6,578,887 | B1 | * | 6/2003 | Kienzler | 292/321 |
| 6,588,812 | B1 | | 7/2003 | Garcia et al. | |
| 6,962,376 | B2 | | 11/2005 | Palzkill et al. | |
| 6,966,584 | B2 | | 11/2005 | Debrody et al. | |
| 7,118,144 | B2 | * | 10/2006 | Anderson | 292/307 R |
| 7,131,300 | B1 | | 11/2006 | Monasco | |
| D540,149 | S | | 4/2007 | Tollefson | |
| 7,243,963 | B2 | | 7/2007 | De Lima Castro | |
| D556,012 | S | | 11/2007 | Tollefson | |
| 7,336,170 | B2 | | 2/2008 | Auerbach et al. | |
| 7,370,892 | B2 | * | 5/2008 | Collingham | 292/329 |
| 7,472,933 | B2 | | 1/2009 | Weedon et al. | |
| D597,397 | S | | 8/2009 | Nazzari | |
| 7,740,292 | B1 | | 6/2010 | Fattori et al. | |
| 8,485,572 | B2 | * | 7/2013 | Nazzari | 292/315 |
| 2005/0023844 | A1 | | 2/2005 | Huang | |
| 2006/0119111 | A1 | | 6/2006 | De Lima Castro | |
| 2007/0007776 | A1 | | 1/2007 | Beard et al. | |
| 2007/0040395 | A1 | | 2/2007 | Lee | |
| 2007/0210085 | A1 | | 9/2007 | Robinson | |
| 2011/0148127 | A1 | * | 6/2011 | Nazzari | 292/315 |
| 2011/0210567 | A1 | * | 9/2011 | Nazzari | 292/315 |
| 2013/0277989 | A1 | | 10/2013 | Nazzari | |

FOREIGN PATENT DOCUMENTS

| | | | |
|---|---|---|---|
| EP | 2249328 | A1 | 11/2010 |
| GB | 2168654 | | 6/1986 |
| IT | 660127 | | 1/1964 |
| WO | 0205613 | A2 | 1/2002 |
| WO | 2013003929 | A1 | 10/2013 |

OTHER PUBLICATIONS

International Search Report and Written Opinion Regarding PCT/US2013/036969, Apr. 7, 2013.

International Search Report and Written Opinion Regarding PCT/US97/19166, May 14, 1999.

International Search Report and Written Opinion Regarding PCT/US2010/001749, Aug. 19, 2010.

* cited by examiner

SECURITY SEAL ASSEMBLY

BACKGROUND

A. Field

This invention relates to a security seal for sealing articles or mechanisms against tampering in a manner revealing any tampering with the seal that would release or open the seal.

B. Related Art

Security seals are known for sealing articles and mechanisms such as, for example, electric, gas and water meters, against tampering in a manner that reveals any tampering with the seal for the purpose obtaining access to the sealed article or mechanism. Such seals are revealed, for example, in U.S. Pat. No. 5,782,513 granted Jul. 21, 1998 to Ian Nazzari; U.S. Pat. No. 6,283,517 granted Sep. 4, 2001 to Ian Nazzari; U.S. Pat. No. 998,878 granted to Dinsmoor; U.S. Pat. No. 1,132,970 granted Mar. 23, 1915 to Peyton; U.S. Pat. No. 1,878,991 granted. Sep. 20, 1932 to Murray; U.S. Pat. No. 5,427,423 granted Jun. 27, 1995 to Georgopoulos; U.S. Pat. No. 6,996,584 granted Nov. 22, 2005 to Debrody et al.; and U.S. Pat. No. 7,243,963 granted Jul. 17, 2007 to Castro.

Known prior art tamper indicating seals tend to be costly and/or are not sufficiently secure against surreptitious tampering by imaginative thieves or intruders using special tools and equipment designed to open the seals without any visible or readily visible sign showing such opening. In the case of lock wire or hasp type seals that have internal detents or locking elements designed to prevent opening of the seal and release of the hasp or wire once the seal is connected to the article or mechanism to be sealed and closed, thieves or intruders have been found to use small drills or punches to reach the locking detents or locking elements inside the seal body and thereby release the detents of locking elements with only a small, difficult to observe, hole left in the seal outer body as the only evidence of tampering with the seal. The thieves or intruders are thus able to gain access to the previously sealed articles or mechanisms without detection, and to replace the seal in a sealing mode after the tampering without visible signs of damage to the seal because the seal does not readily show the manner in which the seal was opened.

There is a need, therefore, for a tamper indicating security seal that provides better resistance against surreptitious outside access to the locking mechanism within the seal, particularly in the environment of a security seal using bendable locking fingers engaging fixed abutments within the seal body.

SUMMARY OF THE INVENTION

The present invention provides improved security against surreptitious, unauthorized access to the internal locking mechanism of a security seal that employs a captured lock wire for sealing an article or mechanism against visible tampering with.

The seal comprises a body assembly including a locking insert and an outer body, wherein the outer body has an upper end, a central cavity having an opening facing the upper end, and a cavity bottom. A central guide having opposed sides is located centrally within the cavity arising upwardly from the cavity bottom. The central guide has along a side thereof at least an upper and a lower locking abutment vertically spaced apart from each other and projecting distally from said one side, said locking abutments having locking finger engaging surfaces on lower sides thereof. The locking insert includes a first and second downwardly extending leg and a central opening between the legs. A first and second locking finger, each having a distal end and being connected in a cantilever manner at an end opposite said distal end to the second leg in a vertically spaced apart relationship along said second leg, extends from the second leg in an upwardly diagonal direction toward the central opening. The locking fingers are configured to be resiliently bendable laterally to a sufficient extent under lateral applied force to permit lateral movement of their respective distal ends from at-rest positions and to return to said at-rest positions after removal of said lateral applied force. The locking insert has a main body central wall to which the first and second legs are attached and from which the first and second legs extend downwardly. The central wall, first and second legs and locking fingers are configured to be received and to fit closely within said central cavity with the first and second legs disposed on opposite sides of said central guide in juxtaposed relationship. The distal ends of said first and second locking fingers are configured to be respectively juxtaposed said locking finger engaging surfaces from below said upper and lower locking abutments when the locking insert is fully received in said central cavity, thereby resisting any motion of the locking insert in a direction of withdrawal upwardly from the central cavity.

This arrangement of seal elements provides improved resistance to tampering with the locking fingers by drilling or punching through the outer and inner body elements to reach the locking fingers to release them from the locking abutments in a manner not readily visible and which would permit re-assembly of the seal elements after opening of same to further hide the unauthorized access to the article or mechanism that is sealed.

An arrangement of lock wire apertures and grooves on or in the locking insert and outer body enable a lock wire to be threaded by a user through an article or mechanism to be sealed and then through the seal outer body and locking insert in a manner permanently securing a lock wire to the seal outer body and locking insert after the insert is fully received in the central cavity of the outer body.

A security seal assembly includes the above described seal body assembly and a lock wire that may be secured or captured at one end thereof by the seal locking insert or the outer body. The seal assembly thus cannot be opened to release the lock wire without evident damage to the seal locking insert, outer body or lock wire elements, which would indicate tampering with the seal assembly.

DESCRIPTION OF THE DRAWINGS

With reference to the appended drawings.

DETAILED DESCRIPTION OF EXEMPLARY EMBODIMENTS OF THE INVENTION

Figure 2:
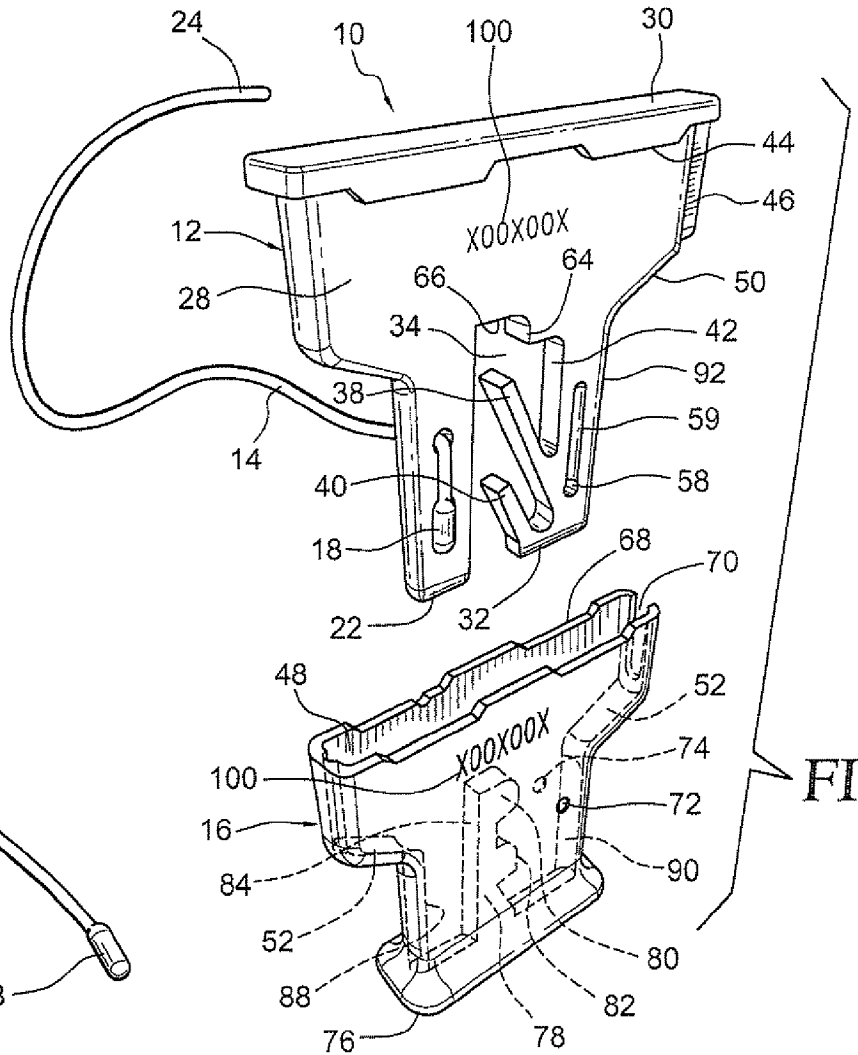
FIG. 2 is a perspective exploded view of the locking insert element, the lock wire and the outer body of the security seal assembly.
Figure 8:
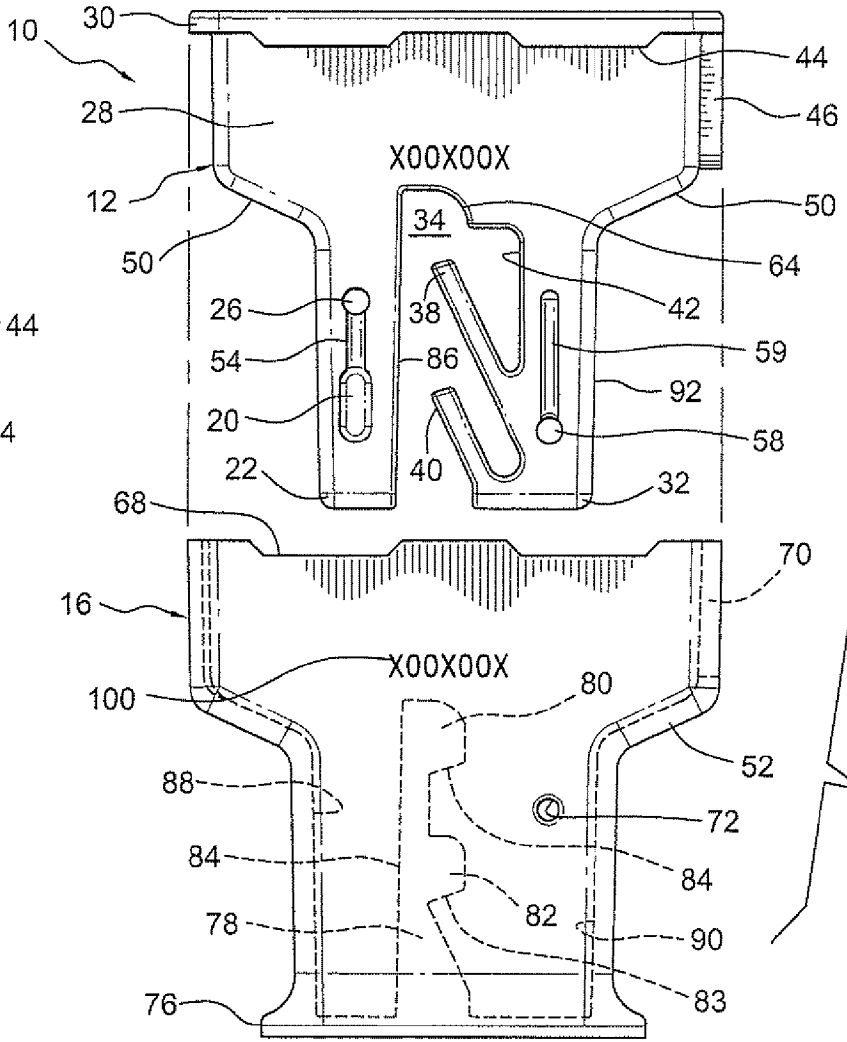
FIG. 8 is an exploded front elevation view of the insert and outer body shown in FIGS. 1-7.

With reference to FIGS. 2 and 8 in the appended drawings, a first embodiment of an exemplary security seal assembly 10 according to the present invention is shown in exploded view, and includes a locking insert 12, a lock wire 14, and an outer body 16. At least outer body 16 preferably is made of transparent or material to reveal the inner assembly of the seal and to enable inspection of the locking fingers and the lock wire within the seal after the seal elements have been securely assembled during use of the seal. The locking insert 12 and the outer body 16 may be referred to herein as a security seal body assembly.

Figure 1:
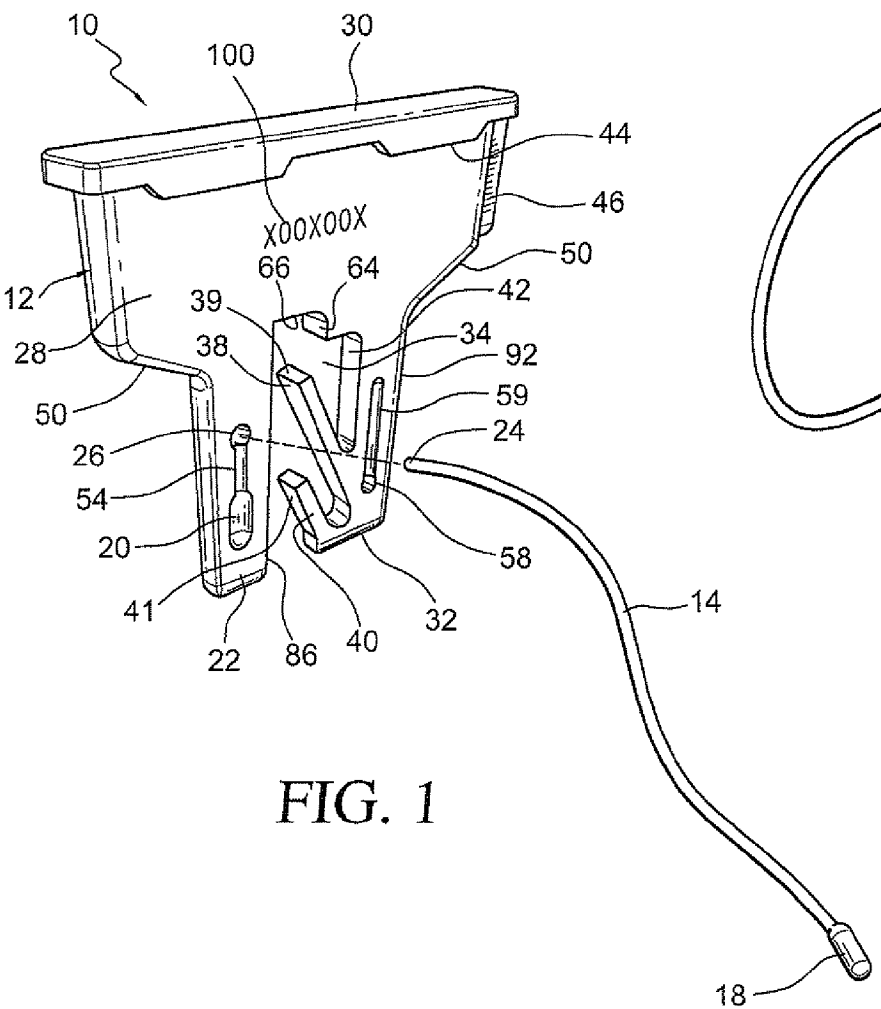
FIG. 1 is a perspective view of the locking insert element and lock wire of the security seal assembly according to an exemplary embodiment this invention.

As seen in FIG. 1, the lock wire 14 in this embodiment is a separate element before assembly with the locking insert 12, which is done by placing the lock wire head 18 into the lock wire socket 20 as seen in FIG. 2 provided on the front side of the first leg 22 of the locking insert 12 and threading the free end 24 of the lock wire 14 through the first lock wire aperture 26 provided in the first leg 22 from the front to the rear side thereof.

Figure 4:
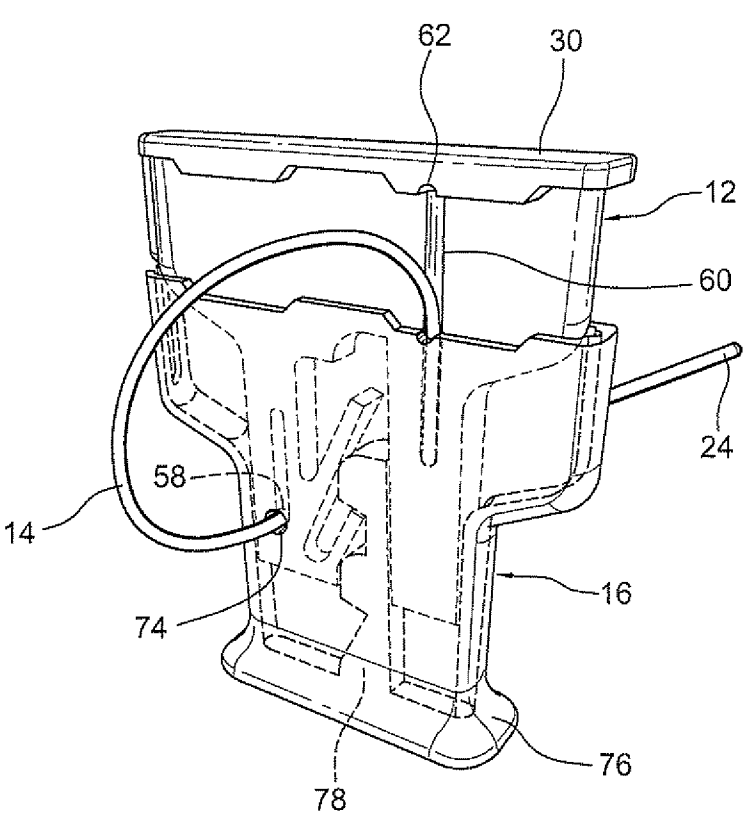
FIG. 4 is another partially assembled rear view of the security seal assembly showing the lock wire inserted through the rear lock wire aperture.
Figure 3:
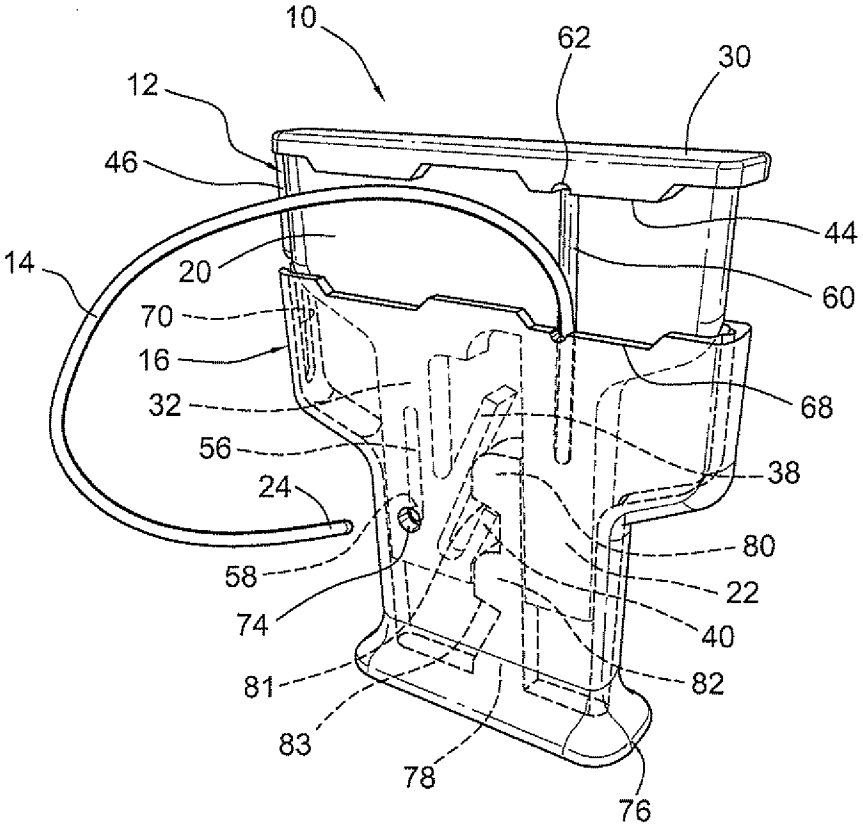
FIG. 3 is a rear view of a partially assembled security seal assembly.

The locking insert 12 comprises a main body central wall 28 depending downwardly as illustrated below a locking insert cover 30 that includes a front side as shown in FIGS. 1 and 2 and a rear side as shown in FIGS. 3 and 4.

Locking insert 12 also has a second leg 32 extending essentially parallel to first leg 22, and both the first and second legs 22, 32 of the locking insert extend perpendicular to the locking insert cover 30 in a downward direction as illustrated. A central opening 34 is provided between the first and second legs 22, 32.

The terms "front", "rear", "upwardly", "downwardly" and similar expressions denoting orientation or position as used in this description are used with reference to the drawings to describe relative orientations, directions or positions of the elements relative to each other as illustrated for convenience only and are not intended to denote actual orientations or directions in actual use, since in actual use the orientations and directions of the seal elements could exist in any orientation of direction, depending on the position of the seal.

Vertically spaced inclined cantilevered locking fingers 38, 40 extend inwardly and upwardly at a diagonal angle from an inner side edge 42 of second leg 32 and terminate in the central opening 34 between the first and second legs 22, 32, as seen in FIG. 1. The fingers 38, 40 are formed of the preferably plastic material of the locking insert 12 and are sufficiently flexible and resilient at the connection between the fingers 38, 40 and the second leg 32 of the locking insert 12 that the fingers may be resiliently bent or deflected inwardly towards the second leg when pressed from the side of the fingers opposite the leg 32 and will spring back to their original at-rest position when the pressing force is removed. Each finger 38, 40 has a distal or free end 39, 41, respectively, opposite the end of the fingers attached to the leg 32. The locking fingers 38, 40 moreover will have sufficient structural columnar strength to resist compression and buckling during use of the seal when the locking fingers 38, 40 engage the locking abutments 80 and 82 from beneath with the locking insert fully inserted in the outer body 16.

The locking insert cover 30 is somewhat larger in thickness than the central wall 20 and has laterally spaced cover projections 44 on the front and rear sides of the cover extending downwardly as shown perpendicular to the top side of the cover 30.

The locking insert 12 also has a locking insert closure edge 46 that projects laterally from one side of the locking insert along an upper portion of the central wall 28. The function of this closure edge will be explained in the description below.

The outer body 16 has a central cavity 48 with an opening located at and facing towards the upper end of the outer body, the cavity being intended to receive the central wall 28 and first and second legs 22, 32 of the locking insert 12 (except the cover 30) in a snug fitting relationship. Thus, the thickness of the locking insert including the central wall, the legs 22, 32 and the locking fingers 38, 40 is dimensioned to closely fit into the central cavity 48 of the outer body. The cavity 48 moreover is shaped to conform closely with the shape of the locking insert below the cover 30, as illustrated. In this example, the locking insert 12 has laterally spaced shoulders 50 at the upper area of the central wall 28 of the locking insert that serve as a transition between the upper wider area of the central wall 28 and the lower more narrow portion of the locking insert defined by the first and second legs 22, 32. The inner space of the outer body central cavity 48 is shaped to closely conform to the outer form of the locking insert 12, and accordingly the inner space includes inner shoulders 52 that will be juxtaposed with the locking insert shoulders 50 when the locking insert is fully assembled within the outer body. Likewise, the lower ends of the first and second legs 22, 32 will be juxtaposed with the bottom wall of the cavity 48.

The locking insert 12 has a first lock wire groove 54 extending vertically as shown in the front wall of the first leg 22 that intersects the lock wire head socket 20 from above. The first lock wire aperture 26 intersects the first lock wire slot 54 at an upper end of the slot. As previously described, the first lock wire aperture 26 extends through the first leg 22 from the front to the rear side thereof.

A second lock wire groove 56 extends vertically along the rear side of the first leg 22 (see FIG. 3) and intersects at its lower end the first lock wire aperture 26. The first and second lock wire grooves 54 and 56 extend parallel to and opposite each other on the first leg 22. The second lock wire groove 56 extends upwardly to the underside of the cover 30 of the locking insert, and a lock wire notch 62 is provided under the cover 30 in the adjacent insert cover projection 44. The notch 62 is located in alignment with the second lock wire groove 56 (see FIG. 3).

A second lock wire aperture 58 is provided in the second leg 32 of the locking insert 12 and extends through the second leg from front to back. A third lock wire groove 59 extends vertically on the front side of the second leg 32 of the locking insert 12 and intersects the second lock wire aperture 58 at its lower end, and a fourth lock wire groove 60 provided on the rear side of the second leg 32 of locking insert 12 extends vertically along the second leg parallel to and opposite the third lock wire groove 59. The third and front grooves extend along the second leg only for a limited length such that when the locking insert is fully received in the central cavity 48 of the outer body 16, the upper ends of the third and fourth grooves 59 and 60 will be aligned with the front and rear outer body lock wire apertures 72, 74 to be described below.

A locking insert upper transverse abutment 64 extends downwardly and inwardly from the upper wall 66 of the central opening 34 and the inner side edge 42 of the second leg, respectively, above the upper locking finger 38.

The outer body 16 is configured and arranged to receive the locking insert 12 within the central cavity 48 in a manner to be described below, and includes along the upper edges of the outer body on opposite sides of the opening to the cavity 48 cover projection mating depressions 68 that are intended to receive and cooperate with the locking insert cover projections 44 when the locking insert 12 is fully received in the central cavity 48 of the outer body 16.

The outer body 16 also is provided with an outer body side slot 70 that receives the locking insert closure edge 46 of the locking insert 12 when the locking insert is received in the outer body. When so located, the closure edge 46 essentially closes the side slot 70.

Outer body 16 includes a front outer body lock wire aperture 72 and a rear outer body lock wire aperture 74, the purpose of which will be described below.

The outer body 16 has a base 76 that is somewhat enlarged compared to the main body of the outer body to facilitate manipulation of the seal assembly during use.

Projecting upwardly from the bottom of the central cavity 48 of the outer body 16 is a central guide or locking projection 78 that is fixed to the outer body preferably by molding the projection 78 integrally with the outer body and/or the base 76 of the outer body.

Figure 6:
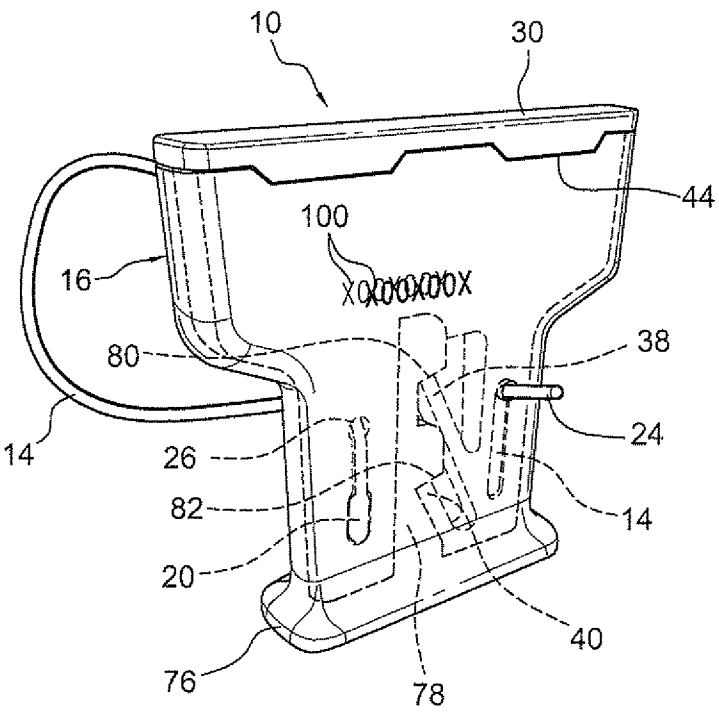
FIG. 6 is a front view of the fully assembled security seal.

The central guide 78 includes upper and lower locking abutments 80, 82 that project outwardly from one side of the guide projection 78 and face towards the side of the central cavity 48 that will be occupied by the distal ends of the locking fingers 38, 40 (i.e., towards leg 32 of locking insert 12) when the locking insert 12 is received in the central cavity 48, as seen in FIGS. 2-8. Each abutment 80, 82 has a lower locking finger engaging surface 81, 83 on the under or lower side of the abutment that will engage the distal end 39, 41 of a respective locking finger 38, 40 when the locking insert is fully received within the central cavity 48. The side 84 of the central guide projection 78 opposite that of the locking abutments 80, 82 is elongated and will be juxtaposed with the elongated inner side 86 of the first leg 22 of the locking insert 12 when the locking insert 12 is received in the central cavity 48, so that the first leg 22 will be in close fitting relationship between the elongated side 84 of the central projection 78 and the opposed inner wall 88 of the central cavity 48, all as illustrated, for example, in FIGS. 6 and 7. The upper end of the central guide projection 78, as seen in FIG. 6, will be juxtaposed the transverse locking abutment 64 to prevent lateral movement of the upper end of the central guide projection after the locking insert 12 has been fully received in the central cavity 48.

It will also be observed that the second leg 32 of locking insert 12 will be lodged between the central guide and locking projection 78 and the wall 90 of the central cavity 48 that is opposite the inner wall 88, so that the outer elongated side 92 of the second leg 32 is juxtaposed the inner wall 90 when the locking insert 12 is received in the cavity 48 of the outer body 16.

Each security seal body assembly will be permanently marked with a unique serial number 100 and/or other visible identifier that preferably will be placed both on the locking insert, for example on central wall 28, and on the outer body in a manner such that the serial number can be visually matched on the insert 12 and the outer body 16 after the locking insert is fully received in the central cavity 48 because of the transparency of the outer body 16. The serial number or identifier may be placed at other locations on the locking insert 12 and the outer body 16 with or without other indicia such as a bar code, for example, but preferably in permanent manner that resists alteration without a visible indication of tampering. To enable observation of the serial number 100 and any other indicia displayed within the outer body 16, the outer body is made of transparent material or a material sufficiently transparent for the intended purpose, so as to enable viewing of information displayed within the outer body while protecting the displayed information from alteration after assembly. The transparency of outer body 16 also enables visual inspection of the condition of the locking fingers 38, 40 and the lock wire 14 within the seal after assembly and closure of the seal assembly.

Figure 5:
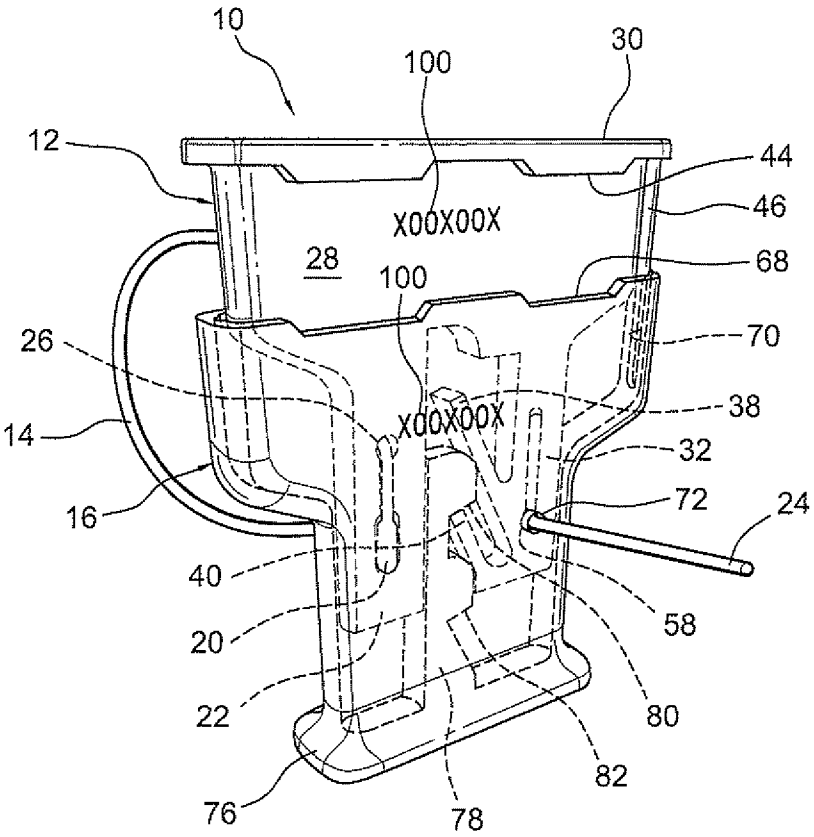
FIG. 5 is a front view of the partially assembled security seal assembly shown in FIG. 3.

In use, the lock wire head 18 of lock wire 14 of the security seal assembly 10 according to the first embodiment will be placed in the lock wire head socket 20 in locking insert 12 by a user or manufacturer and the free end 24 of the lock wire will be threaded through the first lock wire aperture 26 from front to back, as shown in FIG. 2. The locking insert 12 then will be partially inserted into the central cavity 48 of outer body 16 by pressing the locking insert 12 downwardly into the cavity 48 with the lock wire extending along and within the fourth lock wire groove 60 on the rear side of the locking insert 12, as shown in FIG. 3. Upon such partial insertion, the lower locking finger 40 will be deflected sideways to pass over the upper locking abutment 80 and then will spring back to lodge itself under the upper locking abutment 80 as shown in FIGS. 3-5. The upper locking finger 38 will remain above the upper locking abutment 80 and the lower locking finger 40 will rest between the upper and lower abutments 80, 82, thus serving, with the upper finger 38 as a detent to resist further insertion of the locking insert 12 into the cavity 48 until it is desired to fully lock the seal after it has been secured to a device to be sealed.

In the partially inserted condition of the locking insert 12 into the cavity 48 of the outer body 16, the second lock wire aperture 58 in the second leg 32 of the insert 12 will be aligned with the front and rear outer body lock wire apertures 72, 74 as shown in FIG. 3.

When if is desired to fully secure the seal, the free end 24 of the lock wire 14 will be threaded through a device to be secured or sealed (not shown) and then threaded through the rear outer body lock wire aperture 74, the second lock wire aperture 58 in the second leg 32 of the locking insert 12 and the front outer body lock wire aperture 72, so the free end 24 of the lock wire 14 now extends out through the front side of the outer body 16, as shown in FIG. 5.

Figure 7:
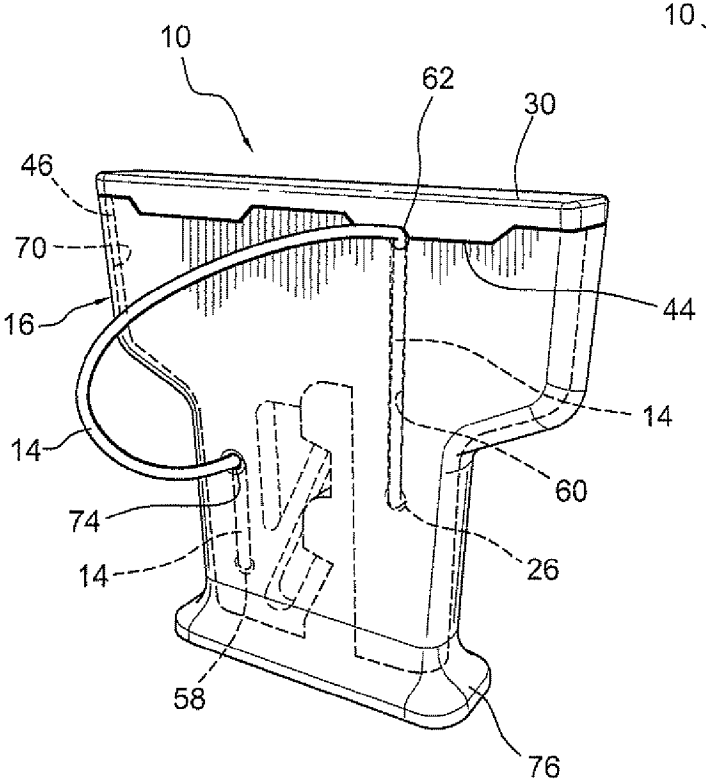
FIG. 7 is a rear view of the fully assembled security seal.

The locking insert 12 is then fully pressed downwardly into the central cavity 48 of the outer body 16 causing the lock wire 24 to lie within fourth lock wire groove 60 in the locking insert 12, the third lock wire groove 59 in the locking insert second leg 32 and the second lock wire groove 56 in the rear side of the locking insert first leg 22 as shown in FIG. 7. Upon such pressing downwardly of the locking insert 12 into the cavity 48, the lower locking finger 40 overrides the lower abutment 82 in the outer body 16 by resiliently deflecting to one side and then springing out to its original at-rest position under and juxtaposed against lower locking abutment 82 and upper locking finger 38 likewise deflects sideways to slide past upper locking abutment 80 and to spring back into its original at-rest position between upper and lower abutments 80, 82, juxtaposed against the lower side of upper locking abutment 80, as shown in FIGS. 6 and 7. In this condition, the abutments 80 and 82 are engaged from below by the locking fingers 38 and 40 respectively and the locking insert 12 is secured against withdrawal from cavity 48 of the outer body 16 by mechanical interference between the locking fingers 38, 40 and the abutments 80, 82. The locking fingers 38, 40 of course shall have sufficient column strength to resist compression axially along their respective lengths to resist withdrawal of the locking insert 12 from the cavity 48 of outer body 16. The lock wire is secured against withdrawal from the seal by the high friction and interference caused by the winding of the lock wire 14 around the lower part of the second leg 32 of the locking insert 12 where the wire passes through the second lock wire aperture 58 after extending along the third wire groove 58 in the front side of the second leg 32 of the insert 12 and the second lock wire groove 56 in the rear side of the second leg 32 of the locking insert 12 between the apertures 72, 58 and 74. The seal is arranged so that the friction forces holding the lock wire 14 against withdrawal from the seal and the geometry of the locking insert, cavity 48 and outer body 16 is such that the lock wire 14 cannot be withdrawn easily from the seal and in the event of a deliberate withdrawal, the wire 14 cannot be threaded back through the apertures and grooves of the assembled and secured seal, so that withdrawal of the lock wire will be visible and reveal tampering with the seal.

When the locking insert 12 is fully inserted into cavity 48, the locking insert cover projections 44 will be received into the mating depressions 68 in the outer body 16, with the lock wire 14 extending through the lock wire notch 62 in the cover 30, as seen in FIG. 7. In this condition, the locking insert cover edge 46 will be received in the outer body side slot 70 to close the slot virtually completely as seen in FIG. 7.

When the locking insert 12 is fully inserted into the cavity 48 of outer body 16, it will be observed from the form and position of the locking insert first leg 22 and the central guide 78 that access to the locking fingers 38, 40 from the side of the outer body 16 where the inner wall 88 is located by drilling or punching is strongly impeded due to the presence of the material of the first locking insert leg 22 and the central guide 78, thereby providing security against surreptitious drilling of punching through the seal laterally from the side nearest to the first locking insert leg 22 to deflect and release the locking fingers 38, 40 from the locking abutments 80, 82 to thereby release the locking insert 12 from the outer body 16 followed by replacement of the locking insert 12 within the outer body 16 in a manner that cannot be readily detected. The configurations of the insert 12, central wall 28, cover 30 and the outer body material all further contribute to the relatively strong integrity of the seal against undetectable intrusion by someone desiring to release the seal from its sealing function. The upper end of the central guide 78 of the outer body 16 will be lodged against the transverse upper abutment 64 and the elongated side 84 of the central guide will be juxtaposed against the inner side 86 of the first leg 22 of the locking insert 12 which in turn will be juxtaposed along its opposite side to the inner wall 88 of the central cavity 48 of the outer body 16, thereby reinforcing the central guide 78 and its associated locking abutments 80, 82 against movement within the cavity 48. The outer elongated side 92 of the second leg 32 will be juxtaposed against the inner wall 90 of the cavity 48 as well when the locking insert is fully received in the cavity 48 as seen in FIGS. 6 and 7.

The seal may be pre-assembled partially by the manufacturer so that the condition of the seal 10 is as shown in FIG. 3 when delivered to the end user, with the lock wire 14 captured within the seal assembly at one end where the lock wire head 18 is located, or the seal may be delivered to the end user in separate pieces including the insert 12, outer body 16 and lock wire 14, leaving it to the end user to assemble the components together for actual use.

An alternate form of the security seal assembly 10 shown in FIGS. 1-7 is shown at 110 in FIGS. 9-12, where the security seal body assembly elements 12 and 16 in FIG. 1 are used in a like manner, with a lock wire 14. In this embodiment, however, the lock wire 14 is molded at one end thereof into the base 112 of the outer body 16 along a length 114 to capture and fix the wire 14 permanently on the base 112 of the security seal 110. All other features and advantages of the first embodiment of FIG. 1 are retained in this embodiment of the security seal, with the added advantage that the lock wire 14 of this second embodiment will not be lost or misplaced during manufacture, shipping and storage, and in the field where the security seals are used, and the manufacturer of the seals need not assemble the lock wires to the locking insert during partial assembly with the locking insert partially received in the central cavity of the outer body of the seal, thereby saving manufacturing cost.

Figure 10:
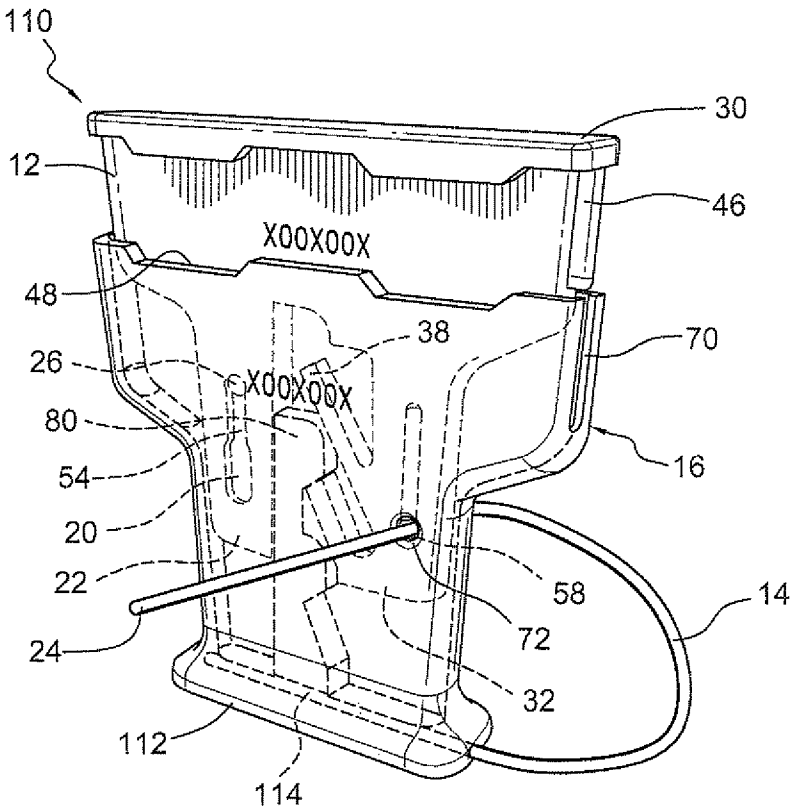
FIG. 10 is a front perspective view of the partially assembled security seal assembly shown in FIG. 9.
Figure 12:
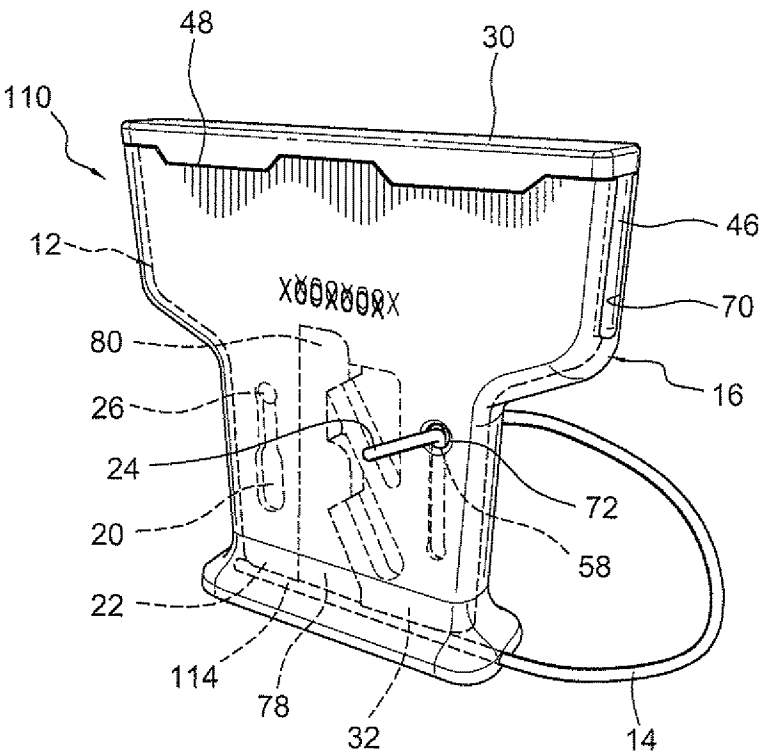
FIG. 12 is a front perspective view of the fully assembled security seal shown in FIG. 11.
Figure 11:
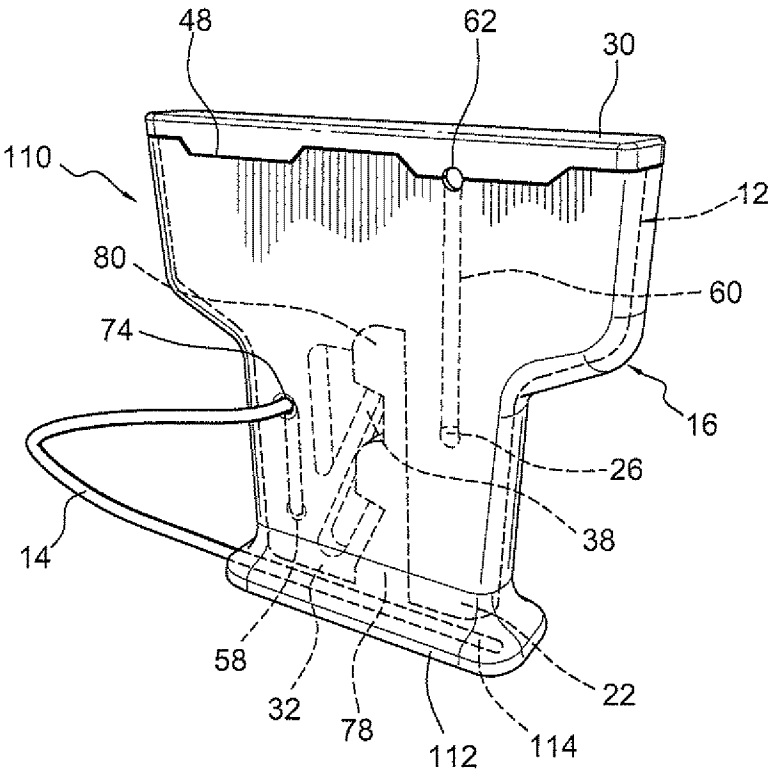
FIG. 11 is a rear perspective view of the fully assembled security seal according to the second embodiment.

In use, the locking insert 12 of the seal 110 is placed into the cavity 48 of the outer body 16 until the upper locking finger 38 is located below the upper locking abutment 80, then the captured wire 14 is threaded through the device to be sealed (not shown) and through apertures 74 and 72 of the outer body 16 and through the second lock wire aperture 58 in the locking insert second leg 32 so the security seal appears as depicted in FIG. 10, with the free end 24 of the lock wire extending beyond the outer body 16. The locking insert 16 then is pressed fully into cavity 48 of outer body 16 as shown in FIGS. 11 and 12 to secure the lock wire 14 to the outer body 16 and the locking insert 12, in the same manner as described in regard to the embodiment of FIG. 1 above.

It will be noted that certain structural details provided in the first embodiment of FIG. 1 remain in the security seal assembly 110 according to the second embodiment, even though they are not used in the second embodiment. For example, the lock wire head socket 20 in the first leg 22 of the locking insert 12, the lock wire first aperture 26 in the first leg 22, the first lock wire groove 54, the fourth lock wire groove 60, and the lock wire notch 62 in the cover 30 all may be provided on or in the locking insert 12 of the second embodiment so that security seals made in accordance with the first and second embodiments may use a common locking insert 12, without the need to re-tool a mold for making the locking insert of the second embodiment.

Likewise, the locking insert 12 of the second embodiment of the seal 110 will fit into the cavity 48 of the outer body 16 of the second embodiment in a manner enabling alignment of the apertures 74, 58 and 72 in the outer body 16 and the locking insert 12 when the locking insert 12 is partially received into the cavity of the outer body 16, like the first embodiment shown in FIG. 1.

Figure 9:
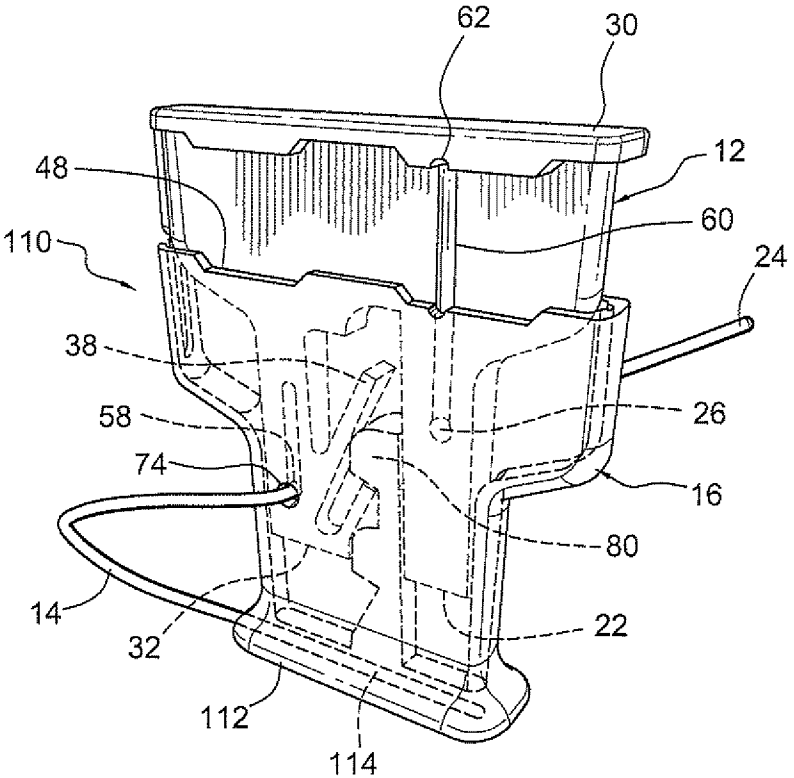
FIG. 9 is a rear perspective view of the security seal assembly in partially assembled condition according to second exemplary embodiment of the invention.
Figure 14:
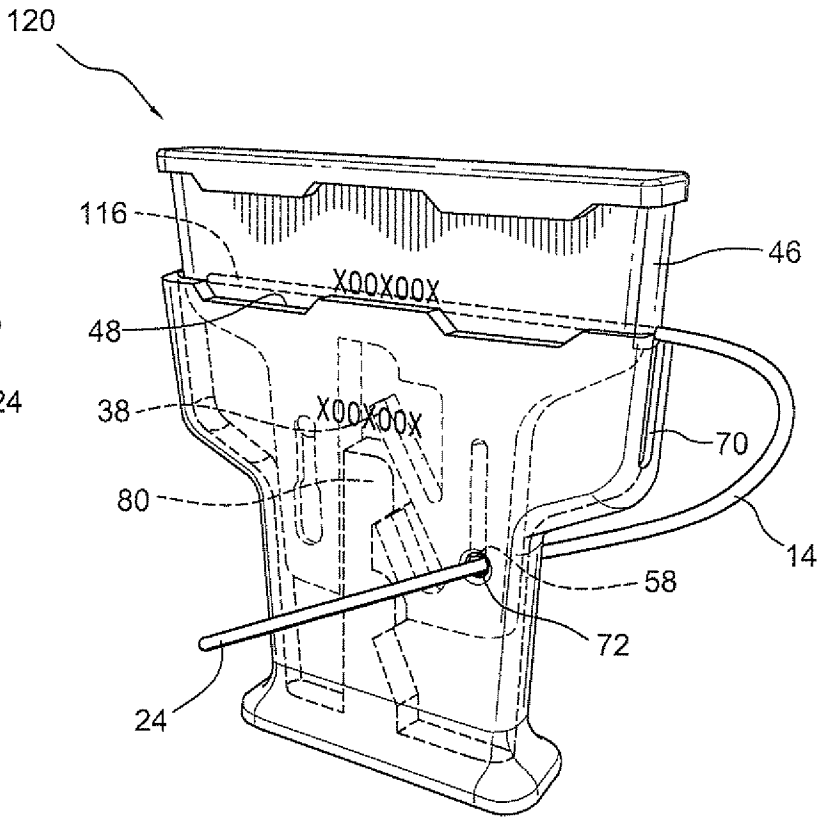
FIG. 14 is a front perspective view of the partially assembled security seal assembly shown in FIG. 13.
Figure 13:
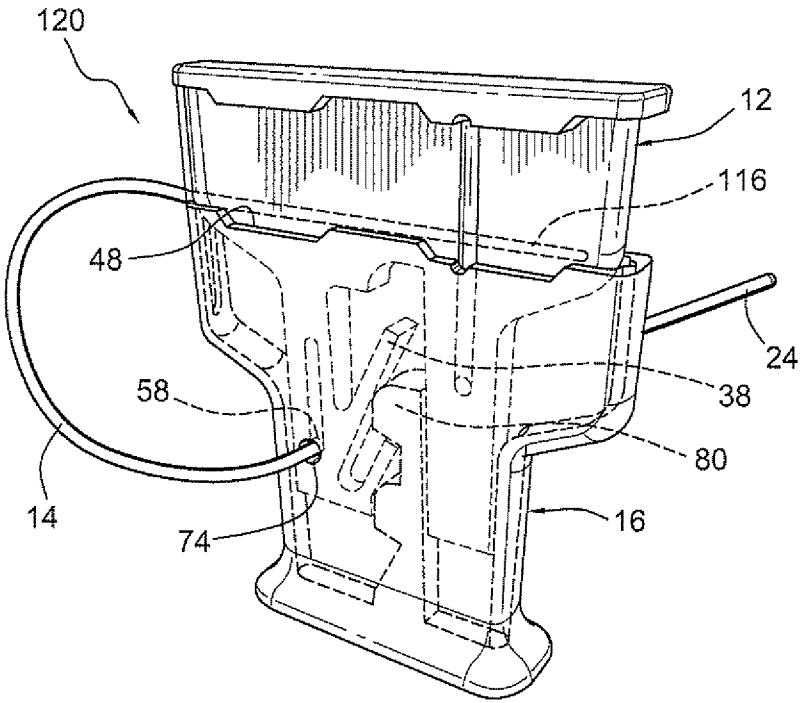
FIG. 13 is a rear perspective view of the partially assembled security seal assembly according to a third exemplary embodiment of the invention.

A third preferred embodiment 120 of a security seal assembly made in accordance with the invention is shown in FIGS. 13-16, where the locking insert 12, outer body 16 and lock wire 14 are similar to corresponding elements of the security seal assembly 10 of the first embodiment of FIG. 1, except an end 116 of the lock wire 14 in this third embodiment is molded into and fixed to the locking insert 12 as shown to thereby capture the lock wire with the locking insert 12 instead of the outer body as depicted in FIG. 9. The one end of the lock wire is molded into the central wall of the locking insert 12 and extends outwardly of the locking insert 12 at the bottom of the locking insert closure edge 46 as shown in FIG. 14, leaving the free end 24 available and accessible for attaching a device to be sealed and then secured to the outer body 16 and locking insert 12 in the manner of the first and second embodiments described above.

Figure 16:
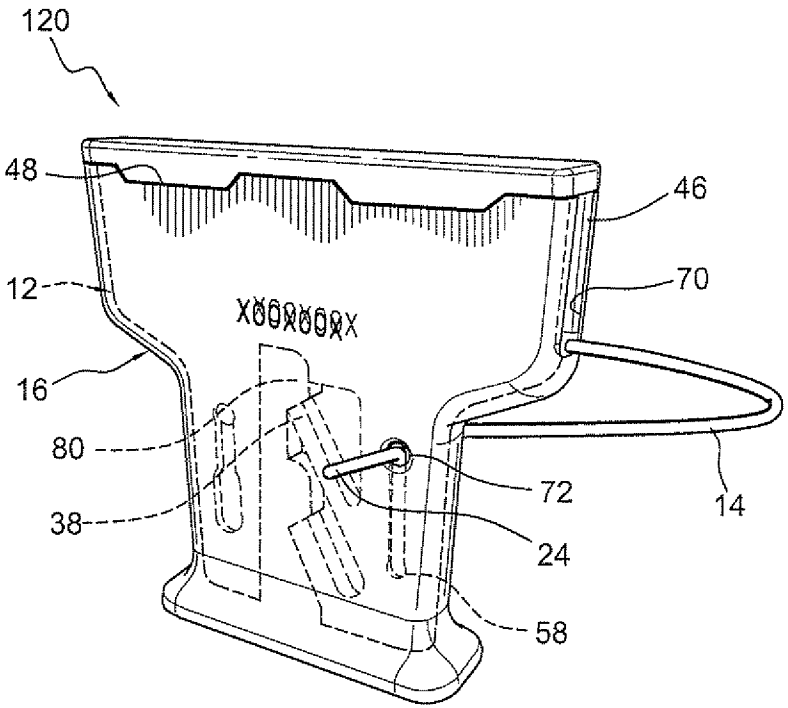
FIG. 16 is a front perspective view of the fully assembled security seal assembly shown in FIG. 15.
Figure 15:
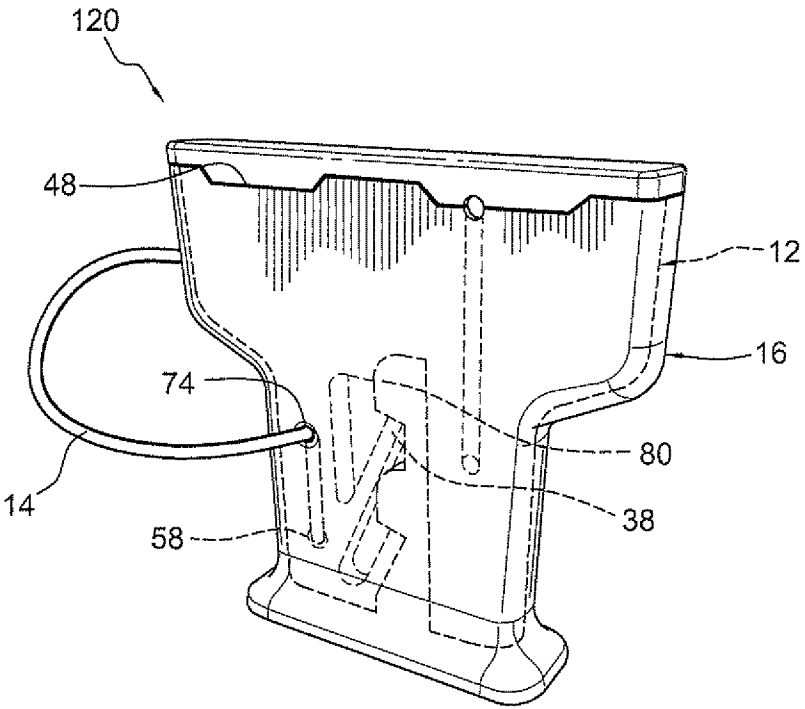
FIG. 15 is a rear perspective view of the fully assembled security seal assembly shown in FIG. 13.

In use, the third embodiment may be partially assembled by placing the locking insert 12 into the central cavity of the outer body 16 until the upper locking finger 38 is located under the upper locking abutment 80 of the outer body 16, and then the free end 24 of the lock wire 14 is threaded through apertures 74, 72 and 58 of the outer body and the locking insert 12 after being threaded through a device to be sealed (not shown). The locking insert 12 is then fully pushed into the central cavity 48 of the outer body 16 to fully secure the lock wire 14 to the outer body 16 and locking insert 12 in the same manner as the embodiment of FIG. 1, as shown in FIGS. 15 and 16.

In the third embodiment, like the second embodiment, features of the locking insert 12 of the first embodiment not actually used in the third embodiment may be retained to enable common molds and dies to be used for the manufacture of the locking inserts used in the first and third embodiments. Likewise, it will be noted that the outer body 16 of the first and third embodiment are identical and interchangeable.

While preferred embodiments of the invention have been described and illustrated in the drawings, the invention is not limited to the specific structures so described and illustrated, but rather is defined in accordance with the appended claims.

I claim:

1. A security seal body assembly comprising a locking insert;

an outer body;

said outer body having an upper end, a central cavity having an opening facing said upper end, and a cavity bottom, and a central guide having opposed sides located centrally within the cavity arising upwardly from the cavity bottom;

said central guide having along a side thereof at least an upper and a lower locking abutment vertically spaced apart from each other and projecting distally from said one side, said locking abutments having locking finger engaging surfaces on lower sides thereof;

said locking insert including a first and second downwardly extending leg and a central opening between the legs;

a first and second locking finger each having a distal end and being connected in a cantilever manner at an end opposite said distal end to the second leg in spaced apart relationship along said second leg, and extending from the second leg in an upwardly diagonal direction toward the central opening;

said locking fingers being configured to be resiliently bendable laterally to a sufficient extent under lateral applied force to permit lateral movement of their respective distal ends from at-rest positions and to return to said at-rest positions after removal of said lateral applied force;

said locking insert having a main body central wall to which the first and second legs are attached and from which the first and second legs extend downwardly;

said central wall, first and second legs and locking fingers being configured to be received and to fit closely within said central cavity with the first and second legs disposed on opposite sides of said central guide in juxtaposed relationship;

the distal ends of said first and second locking fingers being configured to be respectively juxtaposed said locking finger engaging surfaces from below said upper and lower locking abutments when the locking insert is fully received in said central cavity, thereby resisting any motion of the locking insert in a direction of withdrawal upwardly from the central cavity.

2. The security seal body assembly according to claim 1, said locking insert including a lock wire head receiving socket, a first lock wire groove and a lock wire first aperture on a front side of the first leg, said socket, first lock wire groove intersecting said lock wire first aperture.

3. The security seal body assembly according to claim 2, including a fourth lock wire groove on a rear side of the first leg intersecting said first lock wire aperture, and extending parallel with and opposite said first lock wire receiving groove on the front side of the first leg.

4. The security seal body assembly according to claim 3, said locking insert including a second lock wire aperture and a third lock wire groove intersecting said second lock wire aperture on a front side of said second leg.

5. The security seal body assembly according to claim 4, said locking insert including a second lock wire groove on a rear side of said second leg that extends parallel with and opposite from said third lock wire groove on the front side of the second leg and intersecting said second lock wire aperture.

6. The security seal body assembly according to claim 3, said locking insert including a cover at an upper end thereof, said cover including at least one depending locking cover projection and a lock wire notch in said projection aligned with said fourth lock wire groove.

7. The security seal body assembly according to claim 1, said cover including aligned front and rear lock wire apertures located so as to be opposite said second lock wire aperture in said second leg of said locking insert when the locking insert is fully received within said central cavity of the outer body.

8. A security seal assembly comprising the security seal body assembly recited in claim 1, and including an elongated lock wire having one end embedded and fixed within said outer body, and an opposite free end.

9. A security seal assembly comprising the security seal body assembly recited in claim 1, and including an elongated lock wire having one end embedded and fixed within the central body of said locking insert, and an opposite free end.

10. The security seal body assembly according to claim 6, said outer body having projection mating depressions at an upper end thereof adjacent the opening of said central cavity.

11. The security seal body assembly according to claim 1, said central guide having an upper end, and said locking insert having at an upper end of said central opening between the first and second legs;

a transverse upper abutment located at said central opening upper end;

said central guide upper end being juxtaposed said transverse upper abutment when the locking insert is fully receive in said central cavity to thereby limit transverse movement of the central guide upper end within the central opening of the locking insert.

12. A security seal assembly comprising the security seal body assembly recited in claim 1, and including an elongated lock wire having one end removeably affixed to said insert before the insert is fully received within the central cavity of said outer body, and an opposite free end.

* * * * *